US007055586B2

(12) United States Patent
Sakakibara et al.

(10) Patent No.: US 7,055,586 B2
(45) Date of Patent: Jun. 6, 2006

(54) MULTITUBULAR HEAT EXCHANGER

(75) Inventors: Yasufumi Sakakibara, Nagoya (JP); Naruki Harada, Nagoya (JP)

(73) Assignee: Maruyasu Industries Co., Ltd., Nagoya (JP)

( * ) Notice: Subject to any disclaimer, the term of this patent is extended or adjusted under 35 U.S.C. 154(b) by 0 days.

(21) Appl. No.: 10/473,599

(22) PCT Filed: May 22, 2002

(86) PCT No.: PCT/JP02/04924

§ 371 (c)(1),
(2), (4) Date: Oct. 10, 2003

(87) PCT Pub. No.: WO02/097352

PCT Pub. Date: Dec. 5, 2002

(65) Prior Publication Data

US 2004/0134640 A1 Jul. 15, 2004

(30) Foreign Application Priority Data

May 25, 2001 (JP) ..... 2001-156703

(51) Int. Cl.
*F28F 9/00* (2006.01)
*F28F 1/42* (2006.01)

(52) U.S. Cl. ..... 165/158; 165/179; 165/109.1; 138/38

(58) Field of Classification Search ..... 165/169, 165/103, 168, 177, 159, 158, 160, 107.1, 165/183, 180, 181, 51, 53, 166, 179; 138/38, 138/39

See application file for complete search history.

(56) References Cited

U.S. PATENT DOCUMENTS

| | | | | |
|---|---|---|---|---|
| 2,526,157 | A * | 10/1950 | Ramen | 165/82 |
| 4,470,452 | A * | 9/1984 | Rhodes | 165/153 |
| 5,803,162 | A * | 9/1998 | Karbach et al. | 165/109.1 |
| 6,070,616 | A * | 6/2000 | Beck et al. | 138/38 |
| 6,247,523 | B1 * | 6/2001 | Shibagaki et al. | 165/51 |
| 6,293,337 | B1 | 9/2001 | Strähle et al. | |
| 6,321,835 | B1 * | 11/2001 | Damsohn et al. | 165/159 |
| 6,510,870 | B1 * | 1/2003 | Valaszkai et al. | 138/38 |
| 6,666,262 | B1 * | 12/2003 | Parneix et al. | 165/109.1 |

FOREIGN PATENT DOCUMENTS

| | | | |
|---|---|---|---|
| DE | 19526917 | A1 * | 1/1997 |
| DE | 196 54 363 | A1 | 6/1998 |
| DE | 19654366 | A1 * | 6/1998 |
| DE | 19833338 | A1 | 7/1998 |
| EP | 0 772 018 | B1 | 5/1997 |
| EP | 974804 | A2 | 7/1999 |

(Continued)

*Primary Examiner*—Tho Duong
(74) *Attorney, Agent, or Firm*—Armstrong, Kratz, Quintos, Hanson & Brooks, LLP

(57) ABSTRACT

A multi-tube heat exchanger capable of increasing heat exchanging performance without increasing its heat transmitting area, as well as avoiding a reduction in heat exchanging efficiency due to adhering pollutant or the like. The multi-tube heat exchanger includes an inner tube group through which a first fluid passes and an outer tube around which a second fluid passes. The heat transmitting tube is constituted of only a heat transmitting tube main body and a number of lump-like projections formed at a predetermined interval in the length direction on one or both opposing wall faces on longer sides of the heat transmitting tube main body. Longitudinal eddies are generated in high-temperature gas by the, thereby consequently increasing heat exchanging efficiency.

1 Claim, 9 Drawing Sheets

FOREIGN PATENT DOCUMENTS

| | | |
|---|---|---|
| JP | 6-70556 | 12/1986 |
| JP | 63-17393 | 1/1988 |
| JP | 1-184399 | 7/1989 |
| JP | 11-337284 | 12/1999 |
| JP | 2000-97578 | 4/2000 |
| JP | 2001-41109 | 2/2001 |
| JP | 2001-41676 | 2/2001 |
| JP | 2001-241872 | 9/2001 |

* cited by examiner

MULTITUBULAR HEAT EXCHANGER

TECHNICAL FIELD

The present invention relates to a multi-tube heat exchanger in which both ends of each of multiple heat transmitting tubes, comprised of inner tubes (heat transmitting tubes) which a first fluid passes and an outer tube (body) which a second fluid passes, are held and disposed on introduction side/discharge side holding plates located on first fluid introduction side and first fluid discharge side each. More particularly, the present invention concerns a heat exchanger which executes heat exchange by feeding high-speed high-temperature gas (gas) through the heat transmitting tubes while feeding cooling water (liquid) through the body (outer tube). For example, the present invention is preferably applied to an emission gas cooling apparatus (which requires a high degree of heat exchanging performance) and the like, which cools emission gas of an internal combustion engine with cooling water.

BACKGROUND ART

A multi-tube heat exchanger 12 shown in FIGS. 1, 2 are often used if a high degree of heat exchanging performance is required like the case described above.

That is, multiple inner tubes (heat transmitting tubes) group 14 which the first fluid (high-temperature gas) passes through and an outer tube (body) 16 which the second fluid (cooling water) passes through are provided. Both ends of each of the multiple heat transmitting tubes (heat transmitting tubes) 14, 14, . . . are held and disposed on introduction side/discharge side holding plates 18, 20 located on the first fluid introduction side and first fluid discharge side. In the indicated example, the multiple heat transmitting tubes 14, 14 . . . are disposed within the body 16 via introduction side/discharge side holding plates (tube sheet) 18, 20 located on both sides of the body 16. The both ends of the body 16 have introduction/discharge ports (connection pipes) 26, 28 with flanges 26*a*, 28*a* via conical introduction side/discharge side rectifying cylinders (rectifying portions) 22, 24 of truncated cone shape, so that the first fluid (high-temperature gas) can pass through the heat transmitting tubes 14, 14 . . . The body 16 has introduction/discharge nozzles 30, 32 on its top and bottom faces for the second fluid (cooling water) to be capable of passing outside each heat transmitting tube 14.

However, in the multi-tube heat exchanger 12 shown in FIGS. 1, 2, if the quantity of its heat transmitting tubes 14 is increased so as to increase heat exchanging efficiency, flow resistance of cooling water is increased or gas flow velocity is decreased and heat transfer rate drops accompanied thereby, so that consequently, increasing of heat exchanging efficiency is difficult.

Further, the above-mentioned multi-tube heat exchanger 12 needs a number of production steps and its weight tends to be increased.

The inventors of the present invention have proposed a multi-tube heat exchanger having a structure described below (Japanese Patent Application No. 2000-061541: Japanese Patent Application No. 2001-24890; being not published on the priority date) in order to provide a multi-tube heat exchanger capable of increasing heat exchanging efficiency easily and additionally decreasing the number of manufacturing steps.

"Multi-tube heat exchanger containing multiple heat transmitting tubes disposed inside the body characterized in that each of the respective heat transmitting tubes is comprised of a heat transmitting tube main body having a flat section and a number of heat transmitting fins connecting between opposing faces in the length direction of the heat transmitting tube main bodies."

However, in case where the heat transmitting fins having the above-described structure are formed, pollutant (soot, oily stain and the like) is likely to adhere to heat transmitting wall faces and in an extreme case, clogging occurs partially due to pollutant, thereby indicating that a large drop in heat exchanging efficiency (heat exchanging performance) is likely to occur.

DISCLOSURE OF THE INVENTION

In view of the above-described problem, the present invention intends to provide a multi-tube heat exchanger capable of increasing heat exchanging performance without increasing its heat transmitting area and solving a problem on drop in heat exchanging efficiency due to adhering pollutant or the like.

As a result of keen efforts for development by the inventors of the present invention in order to achieve the above-described object, the multi-tube heat exchanger having a structure described below has been reached.

There is provided a multi-tube heat exchanger comprising an inner tube (heat transmitting tube) group in which a first fluid passes and an outer tube (body) in which a second fluid passes, both ends of each multiple heat transmitting tubes being held and disposed on introduction/discharge side holding plates located on each of first fluid introduction side and first fluid discharge side, wherein the heat transmitting tube is constituted of only a heat transmitting tube main body while longitudinal eddy generating means is disposed in the heat transmitting tube main body.

Because the longitudinal eddy generating means is disposed in the heat transmitting tube main body, when the first fluid (high-speed gas or the like) passes through the heat transmitting tube main body which is a high-speed gas flow path, eddies (longitudinal eddies) are generated. The first fluid is disturbed by this eddy thereby relatively increasing heat transmitting rate (heat exchanging efficiency). Thus, the heat exchanging efficiency (cooling efficiency) can be increased even if the heat transmitting fins for increasing the heat transmitting area is not incorporated in the heat transmitting tube main body unlike the conventional example. Because basically, the projection group which is the longitudinal eddy generating means does not increase the heat exchanging efficiency due to increase of the heat transmitting area, the degree of drop in heat transmitting efficiency accompanied by pollutant adhering to the heat transmitting wall face is small and further, adhering of pollutant to the heat transmitting wall face due to generation of the longitudinal eddies is relatively decreased and therefore naturally, partial clogging due to pollutant never occurs. Thus, the degree of drop in heat exchanging efficiency with a passage of time is lower than the conventional heat transmitting fin incorporated type. That is, the problem about drop in heat exchanging efficiency accompanied by pollutant adhering to the heat transmitting wall face is solved.

More specifically, a longitudinal eddy generating means is provided by forming a number of sheet-like or lump-like projections (projection group) at a predetermined interval (predetermined pitch) in the length direction and width direction on one or both of opposing wall faces on longer sides of the heat transmitting tube main body.

The aforementioned projections are formed directly on a wall face of the heat transmitting tube main body by press treatment (stamping etc.). Preferably, the projection is so formed that a face opposing a flow thereof is substantially rectangular and further, by adopting one of following requirements or combining: (1) an attack angle thereof is 20°–80°, (2) the height and width thereof are 0.1–0.8 times the height and width of a flow path thereof, (3) the pitch thereof in flow direction is 1–5 times the height or width of the flow path thereof, press treatment is facilitated, the longitudinal eddy becomes likely to be generated and the heat exchanging efficiency is increased.

BEST MODE FOR CARRYING OUT THE INVENTION

Figure 1:
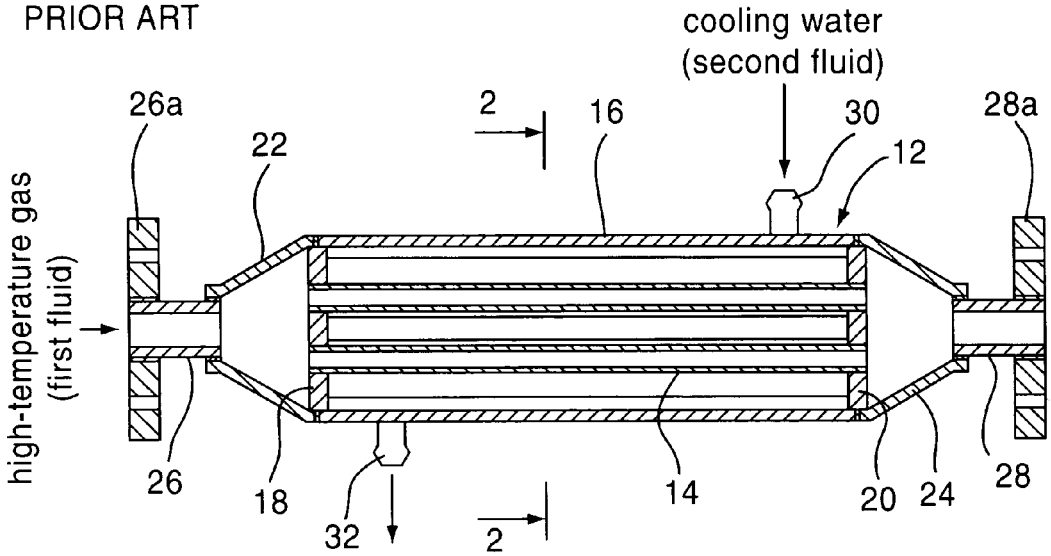
Fig.1 PRIOR ART
FIG. 1 is a longitudinal sectional view showing an example of a conventional multi-tube heat exchanger.

Hereinafter, the embodiments of the present invention will be described with reference to the accompanying drawings. Corresponding components to already mentioned ones are provided with numerals having the same lower two digits.

FIGS. 3, 4, 5, 6 show an example of the multi-tube heat exchanger 112 according to this embodiment.

That is, multiple heat transmitting tubes 114 are disposed via tube fixing plates 118, 120 in a square rod body 116 having the introduction side/discharge side holding plates (tube sheets) 118, 120 on both ends. First fluid introduction port/discharge port (connecting pipes) 126, 128 having flanges 126*a*, 128*a* are provided on both ends of the square rod body 116 via introduction side/discharge side rectifying cylinders (rectifying portions) 122, 124, so that a first fluid (high-temperature gas) can pass through heat transmitting tubes 114, 114, . . .

Here, the heat transmitting tube 114 is composed of only a heat transmitting tube main body 134 constituted of substantially a flat tube.

Introduction/discharge side nozzles 130, 132 are provided on the top and bottom of the square rod body 116 and a second fluid (cooling water) is allowed to pass outside the heat transmitting tubes 114.

Figure 3:
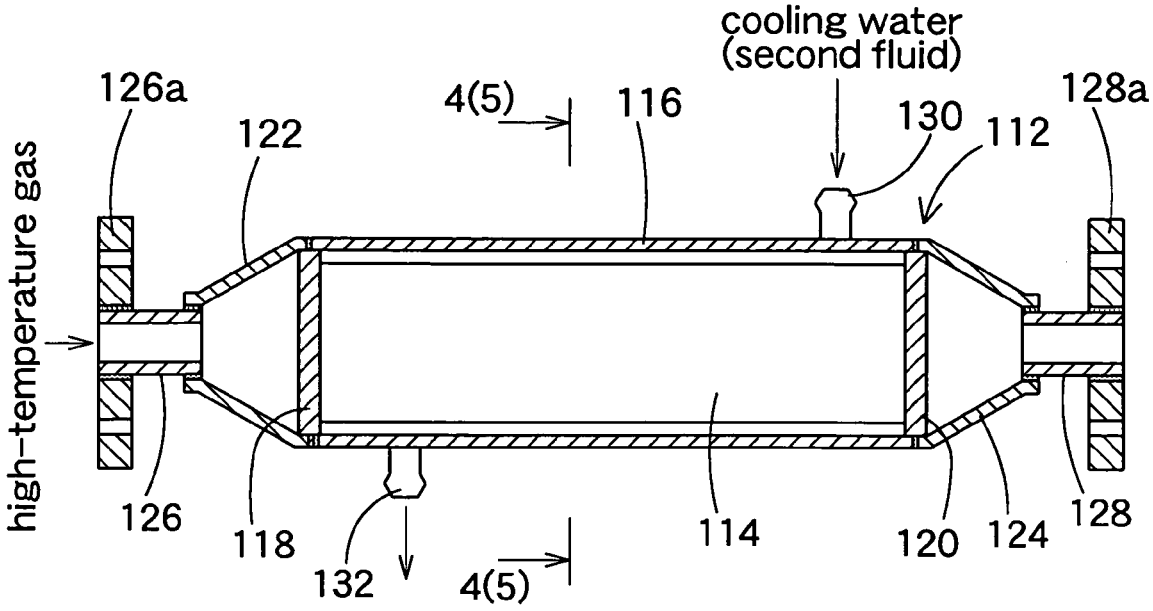
FIG. 3 is a longitudinal sectional view showing an example of a multi-tube heat exchanger according to an embodiment of the present invention.
Figure 4:
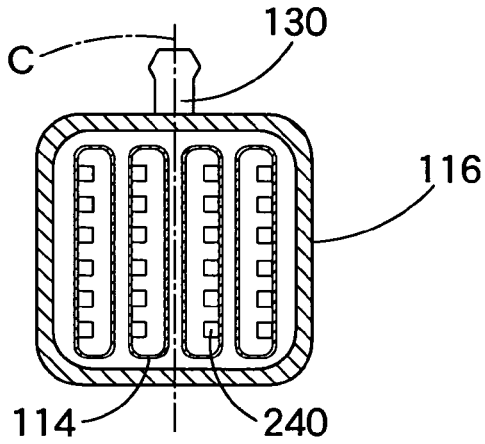
FIG. 4 is a lateral sectional view of an embodiment, taken along the line 4(5)—4(5) of FIG. 3.
Figure 5:
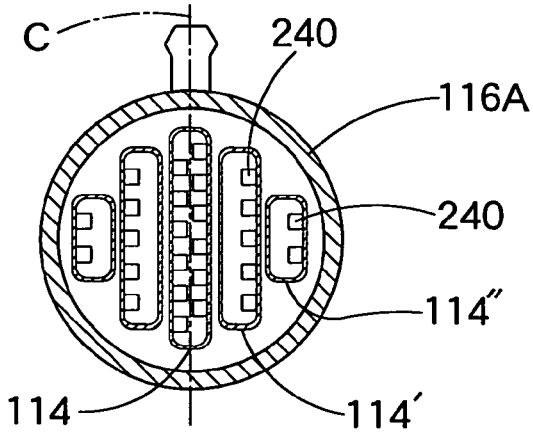
FIG. 5 is a lateral sectional view according to other embodiment.

Although the body may be formed in a cylindrical body 116A as shown in FIG. 5 (corresponding to a portion taken along the line 4(5)—4(5) in FIG. 3), the square rod formation enables the quantity of components to be reduced more as described above. That is, if it is formed in a cylindrical form, it is necessary to prepare components 114, 114', 114" each having a different width as a heat transmitting tube as indicated in the same Figure.

According to this embodiment, each main body (flat tube) of these heat transmitting tubes 114, 114', 114" contains a flow generating means. More specifically, one or both of opposing wall faces 114*a*, 114*b* on longer sides of the flat tube (heat transmitting tube main body) have a number of plate-like or lump-like projections (projection groups) (lump-like projections in the same Figure) 240. As for the configuration of the projection 240, its face opposing flow is substantially rectangular while its plan view shape is substantially rectangular (elongated circle in the same Figure). If the projection 240 adopts this configuration, preferably, it can be formed easily by pressing such as stamping.

Although the projection 240 is formed such that it is projected toward a longitudinal center axis C of each of the bodies 116, 116A in this Figure, it may be formed so as to be directed outwardly (toward the periphery).

Figure 6A:
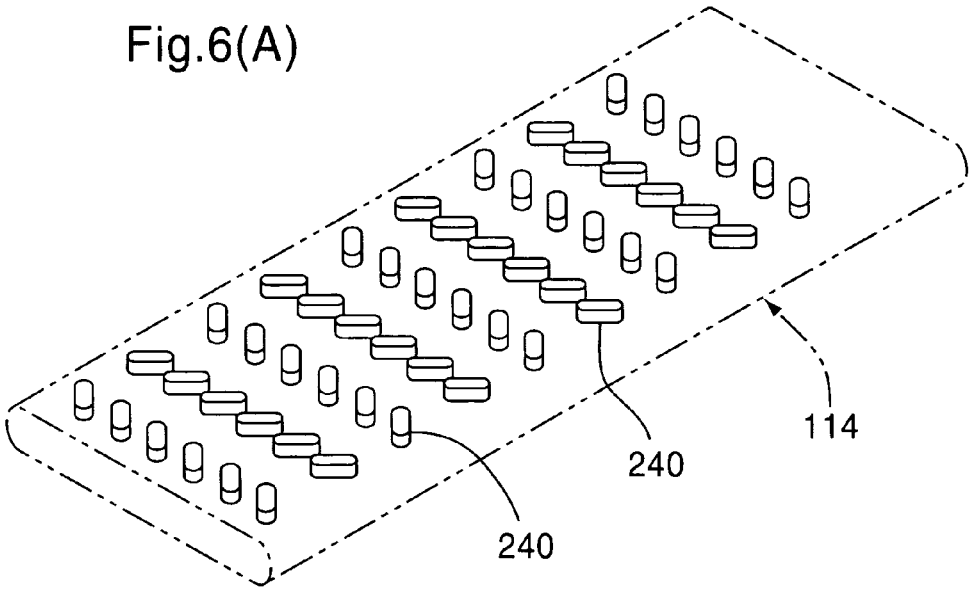
FIGS. 6A and 6B are a perspective view showing an embodiment of a heat transmitting tube in the multi-tube heat exchanger of the present invention and longitudinal/lateral sectional views showing other embodiment.
Figure 6B:
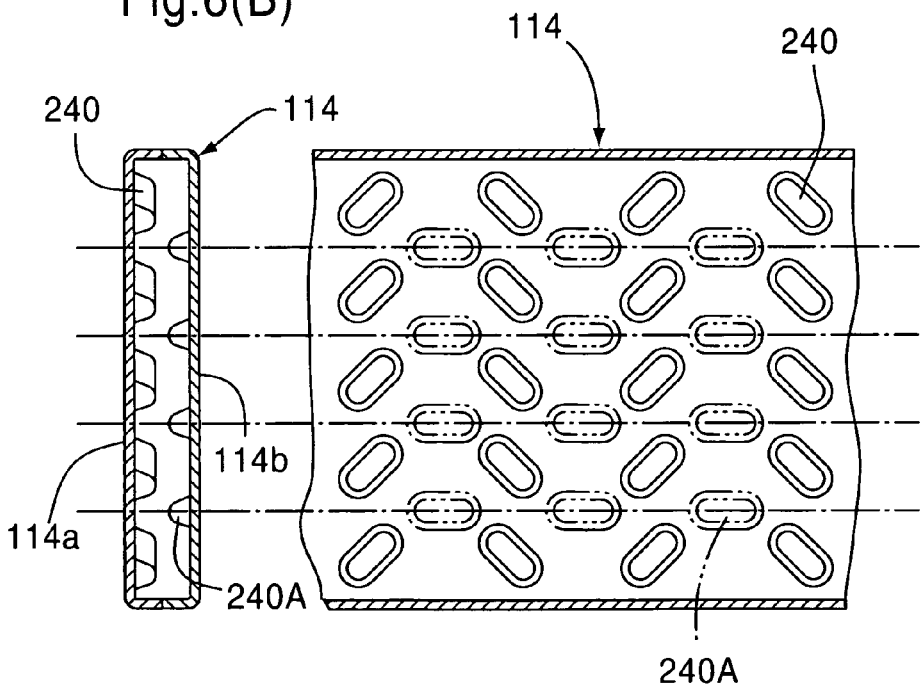
Figure 7A:
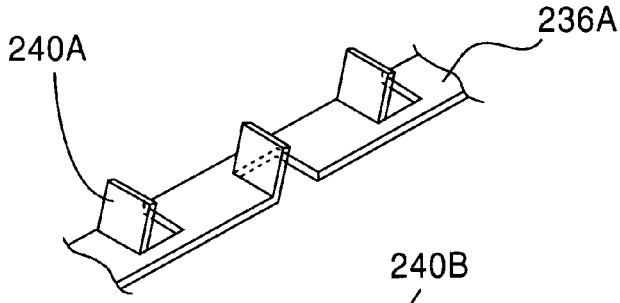
FIG. 7 are perspective views showing respective examples of projection processing thin plates for use in forming projections which generate eddies in the heat transmitting tube main body of the present invention.
Figure 7B:
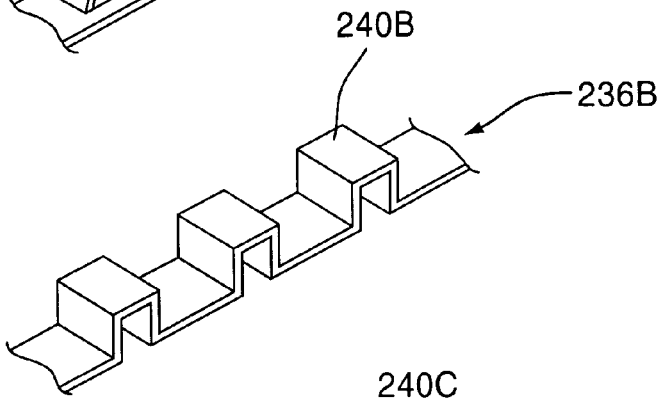
Figure 7C:
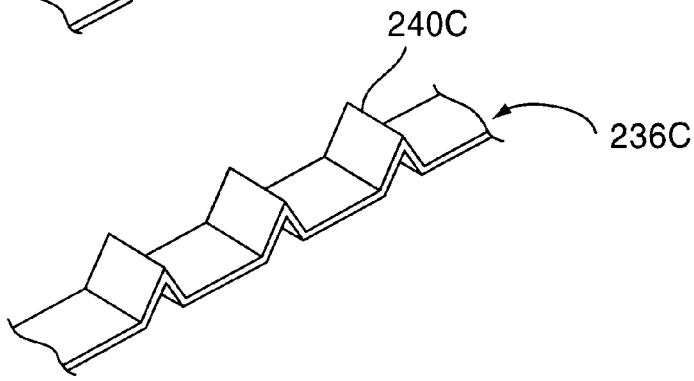
Figure 8A:
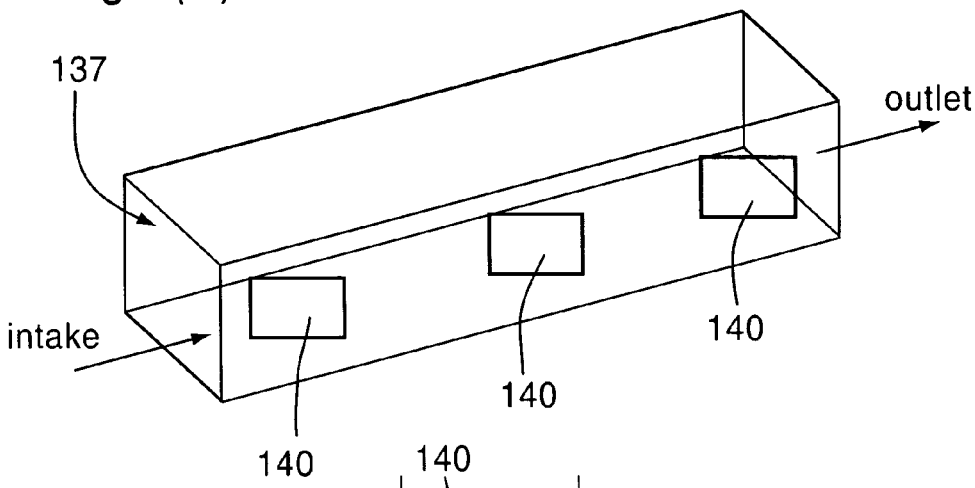
FIG. 8 are an explanatory model diagram of a heat transmitting tube flow path in which projecting plates (projections) are formed and model diagrams indicating respective elements of the projecting plate.
Figure 8B:
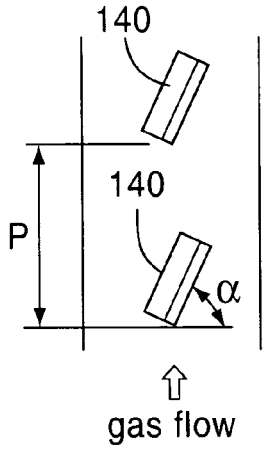
Figure 8C:
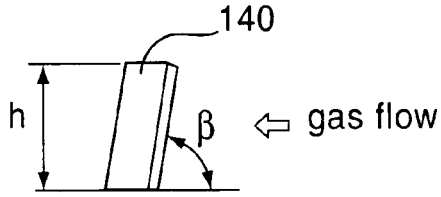
Figure 8D:
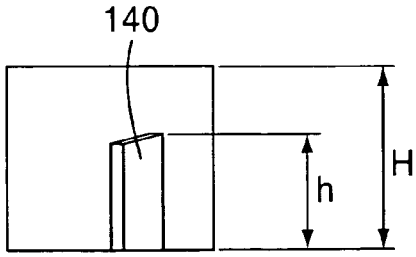

Although in FIGS. 6(A) and 6(B), projections 240 are formed obliquely on one wall face 114*a* of a flat tube alternately in a high-speed gas flow direction, it is permissible to dispose obliquely arranged projections 240 on one wall face 114*a* of the flat tube like FIG. 6(A) and dispose parallel projections 240A between the obliquely arranged projections 240 in the length direction on the other wall face 114*b* in parallel to the gas flow direction. This parallel projection 240A blocks an interference of longitudinal eddies generated by adjacent obliquely arranged projections and reduces pressure loss and further an action for blocking clogging of soot can be expected.

The shape of the face opposing a flow and its plan view shape of the projection 240 are not substantially restricted to the rectangular shape, however may be selected arbitrarily from semi-circle, circle, trapezoid, triangle and the like.

Further, it is permissible to fix a number of projection (projection group) processing metallic thin plates (0.3–0.5 mmt) 236A, 236B, 236C having projection plates 240A, square projections 240B or mountain-like projections 240C formed at a predetermined pitch on a belt-like or rectangular plate (belt-like plate in the same Figure) by soldering or the like to the flat tube 114.

By attaching the above-described heat transmitting tubes 114 to the body (outer tube) 116 as shown in FIG. 6, the multi-tube heat exchanger is produced. Although this heat exchanger has a smaller heat transmitting area than the conventional heat exchanger having the heat transmitting fins, a same or higher heat exchanging efficiency can be secured due to generation of eddies. Further, because the heat transmitting area is small, a sudden drop of the heat exchanging efficiency due to generation of contamination (soot, oil stain and the like) on the heat transmitting part (including the heat transmitting fins) hardly occurs.

Figure 2:
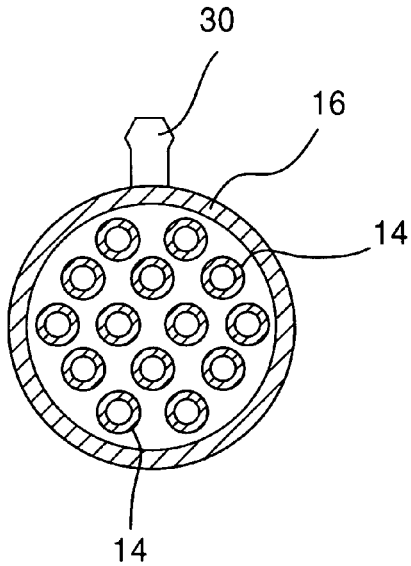
Fig.2 PRIOR ART
FIG. 2 is a sectional view taken along the line 2—2 of FIG. 1.

Although the above embodiment has been described about a case where the section of the heat transmitting tube main body is flat, it may be round in section as shown in FIG. 2, or triangular, square or the like in section.

These heat transmitting tubes are produced in succession by transfer press from a single metallic pipe or by pressing or roll forming from a single sheet material (hoop material).

The lateral section of the outer shape of the heat transmitting tube may be, as shown in the same Figure, of square pipe or round pipe like the conventional example, instead of being flat. The square pipe is more preferable because it allows a belt-like plate having more projections (projection group) to be inserted and fixed more easily upon formation of the projections which will be described below.

In these case, a thin belt-like plate having the projecting plates or projecting lumps are fixed at predetermined pitch within a pipe like a case of the above-described heat transmitting fin.

Figure 9A:
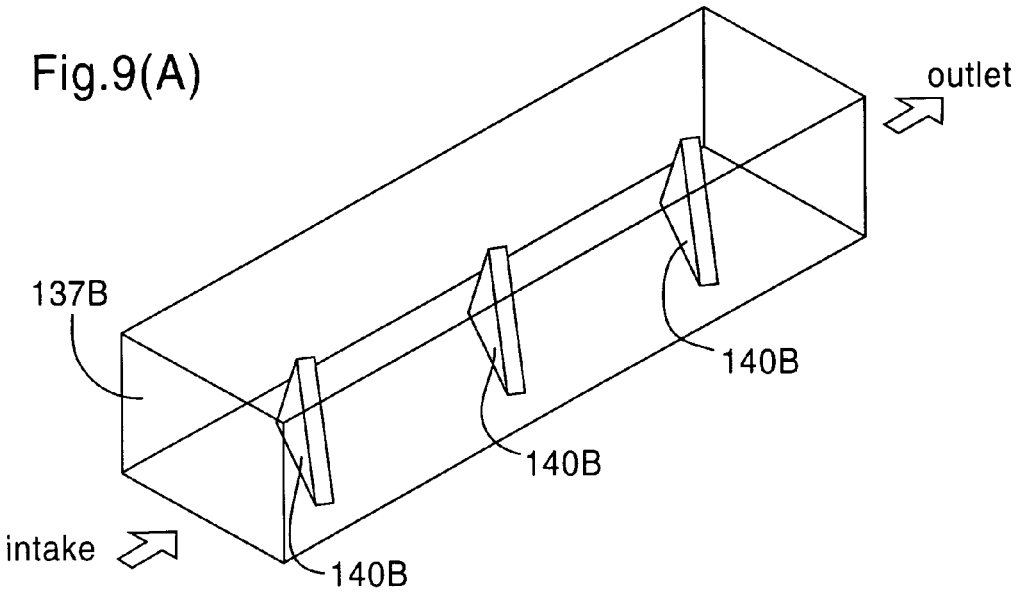
FIG. 9 are model diagrams showing examples of other arrangement (*a*) of the projections and other configuration (*b*)
Figure 9B:
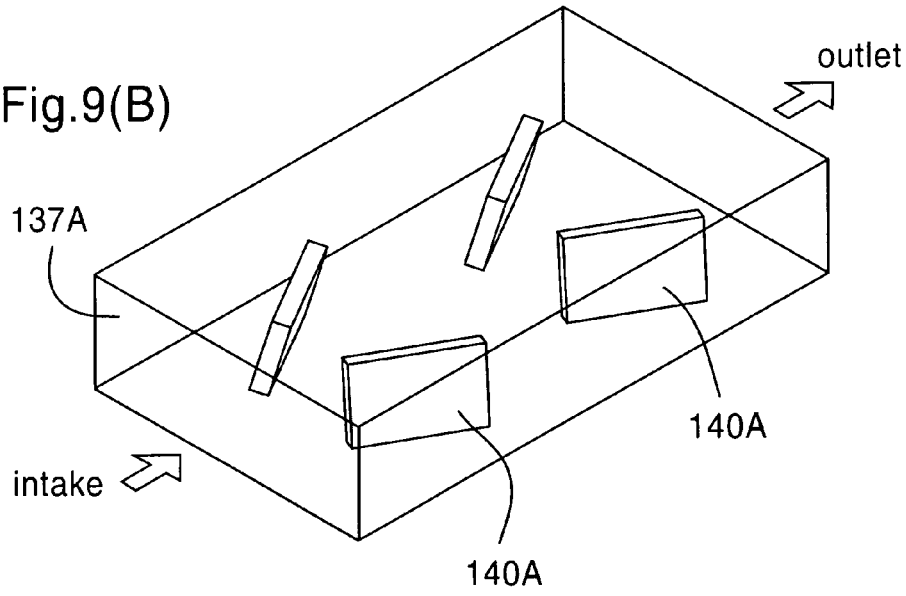

FIGS. 8, 9 show models of various forming embodiment of the projection 140.

FIGS. 8, 9 show models in which the gas flow path is formed in a rectangular section (square) and sheet-like projections 140 are disposed at a predetermined distance for convenience of explanation.

Although usually, the face opposing a flow of the projection 140 is rectangular as described previously, it may be selected arbitrarily from trapezoid, triangle 140B (FIG. 9(*a*)), semi-circle and the like in terms of plan view shape. Further, it is permissible to dispose 140A, 140A as pair in the form of an arrow (counter) as shown in FIG. 9(*b*). That is, any shape is permissible as long as it generates eddies in flow of high-temperature gas or the like (generating gas disturbance) so as to contribute to improvement of heat transmitting rate (heat exchanging efficiency).

Then, when the projection is formed in rectangular shape (projecting plate), it has been found from an experimental simulation that if the configuration characteristic of the projecting plate ((1) attack angle, (2) tilt angle, (3) height, (4) pitch) is in a range described below, heat transmitting rate improvement effect by the projection is exerted (see FIGS. 8–13).

The respective configuration characteristic factors are, in FIG. 8, (a) $\alpha$: projection attack angle and p: projection pitch, (b) $\beta$: projecting plate tilt angle and h: projecting plate height, (c) h: projecting plate height and H: flow path height. Integrated average heat transfer rate (on an entire peripheral wall face) is obtained through simulation by changing the respective configuration characteristics with the tilt angle: 90°, attack angle: 45°, flow path shape: 4 mm×4 mm×220 mmL, projection shape: 1.5 mm×1.5 mm×0.5 mmt as reference. A ratio of the heat transfer rate (ordinate axis) in each graph is expressed with heat transfer rate in case where no projection plate exists under the above condition being 1.0.

FIGS. 10–13 indicating a simulation result presents following facts.

Figure 10:
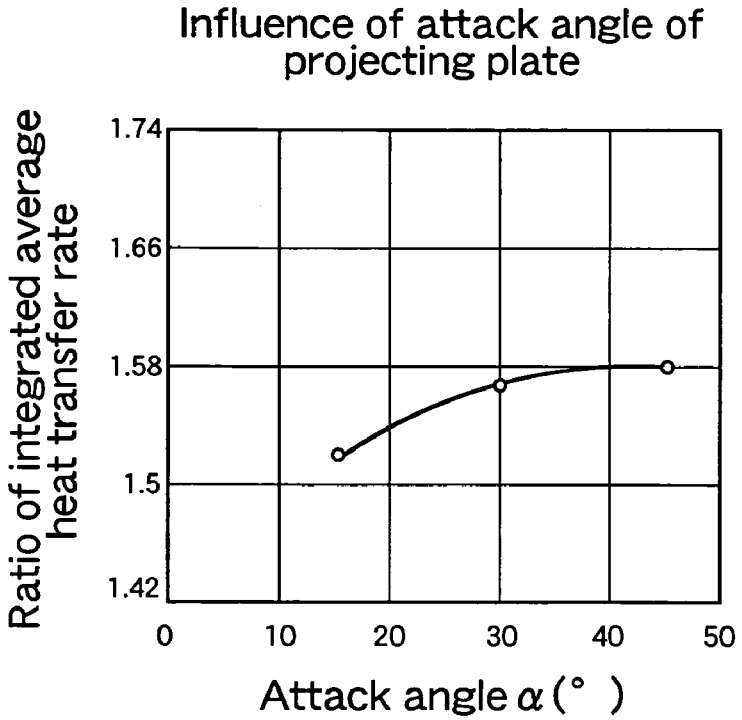
FIG. 10 is a graph diagram showing an influence of projecting plate tilt angle upon heat transfer rate found in a simulation experiment.

(1) FIG. 10: most preferably, the attack angle $\alpha$ of the projecting plate is 45°. Therefore, it can be determined appropriately in a range of 20°–70°, preferably 30°–60° depending on the flow characteristic (velocity, viscosity and the like) and shape of the projection plate. Although the simulation result of the attack angle does not indicate more than 45°, it is estimated that the heat transfer rate will be decreased gradually symmetrically if 45° is exceeded.

Figure 11:
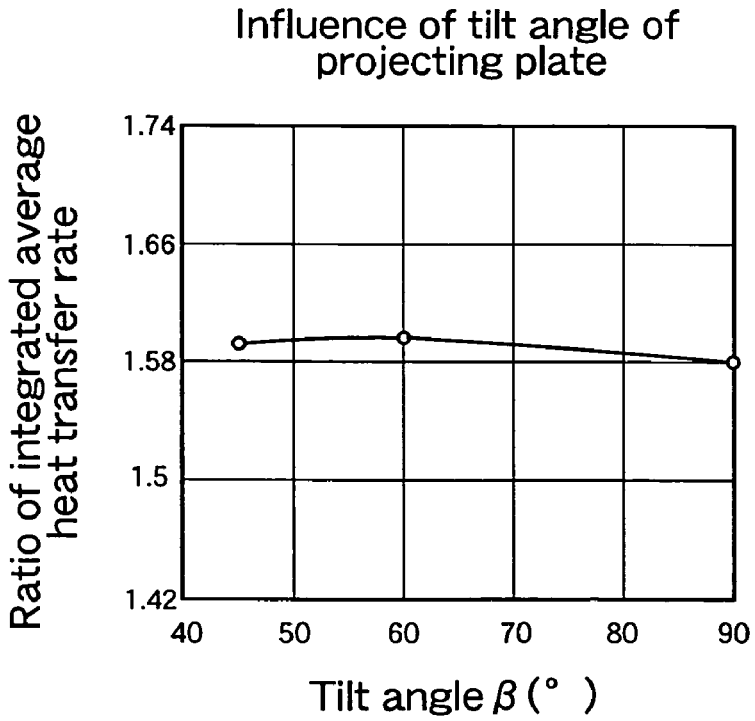
FIG. 11 is a graph showing an influence of attack angle of the projecting plate upon heat transfer rate.

(2) FIG. 11: Because the heat transfer rate is hardly affected if the projecting plate tilt angle $\beta$ is in a range of 30°–90°, it can be substantially 90° in viewpoints of manufacturing and if it is intended to improve heat transfer rate even if slightly, it should be in a range of 45°–75°.

Figure 12:
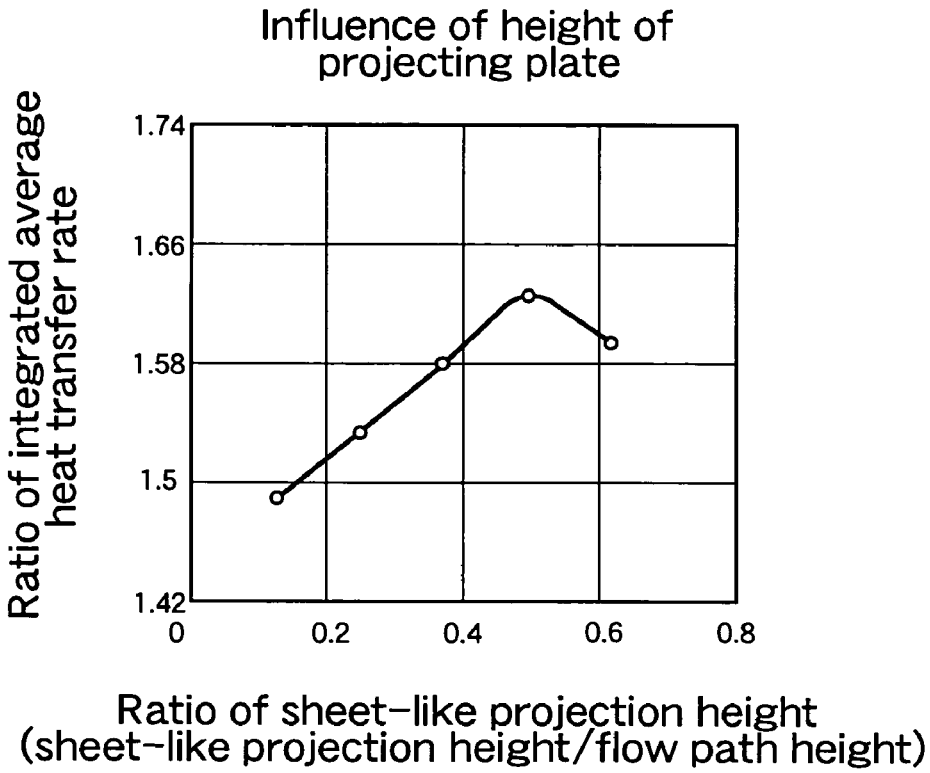
FIG. 12 is a graph showing an influence of the height of the projecting plate upon heat transfer rate.

(3) FIG. 12: The height of the projecting plate is 0.1–0.8 with respect to the height of the flow path, preferably 0.2–0.7, and more preferably 0.4–0.6. The reason is that if it is too low, eddy is unlikely to occur and if it is too high, a rise of heat transfer rate is slight to increase of flow resistance.

Figure 13:
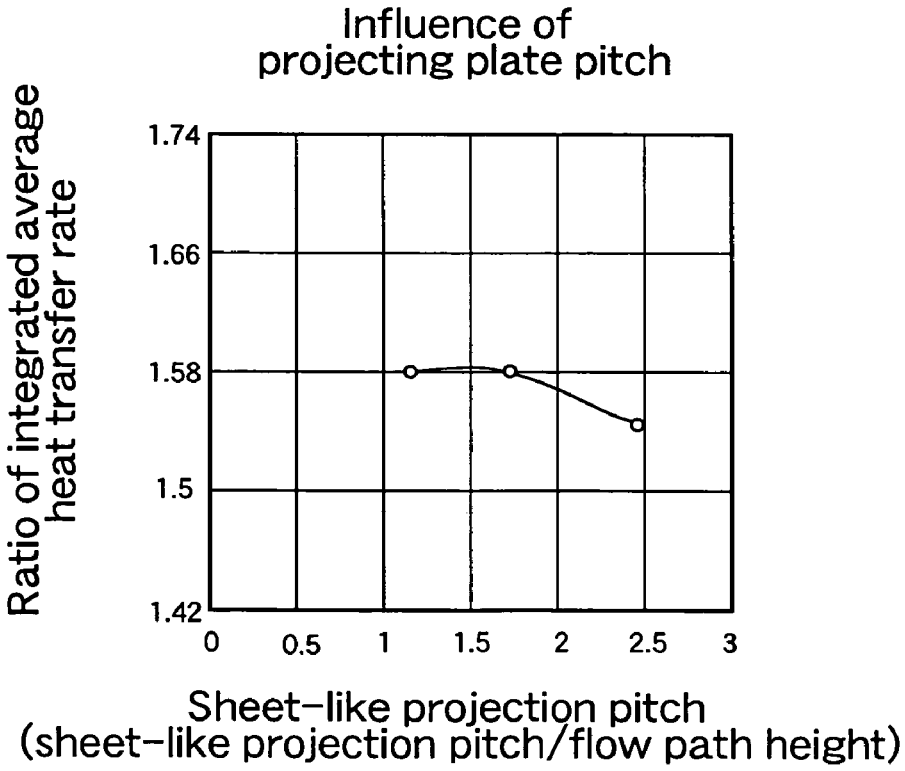
FIG. 13 is a graph showing an influence of the projecting plate pitch upon heat transfer rate.

(4) FIG. 13: If cooling performance is considered first, the projecting plate pitch is 1.0–2.0 times the flow path width, preferably around 1.5 times. Because if the projecting plate pitch is too long, damping of eddy current occurs remarkably, the cooling performance cannot be increased effectively. If the projecting plate pitch is short as described above, it leads to increase of pressure loss and therefore, the pitch is determined from a balance between the cooling performance and pressure loss. In the meantime, in the above (1)–(3), the respective numeric ranges are determined from a balance between the cooling performance and pressure loss.

Further, the inventors of the present invention carried out the same simulation experiment upon a flow path in which the projecting plates are formed and respective flow paths based on a configuration of FIG. 9(*a*)(in which the shape of the projecting plate is changed to an inscribed triangle shape from the above-mentioned basic shape) and a configuration of FIG. 9(*b*). Consequently, the configuration of FIG. 9(*a*) improved the heat transfer rate by about 35% as compared to a case where there was no projection and the configuration of FIG. 9(*b*) improved the heat transfer rate by about 53% as compared to a case where there was no projection, thereby obviously indicating that the heat transfer rate (heat exchanging rate: high-temperature gas cooling efficiency) was improved when the projecting plates were formed.

Next, an example of the manufacturing method of the heat exchanger of this embodiment will described.

Figure 14:
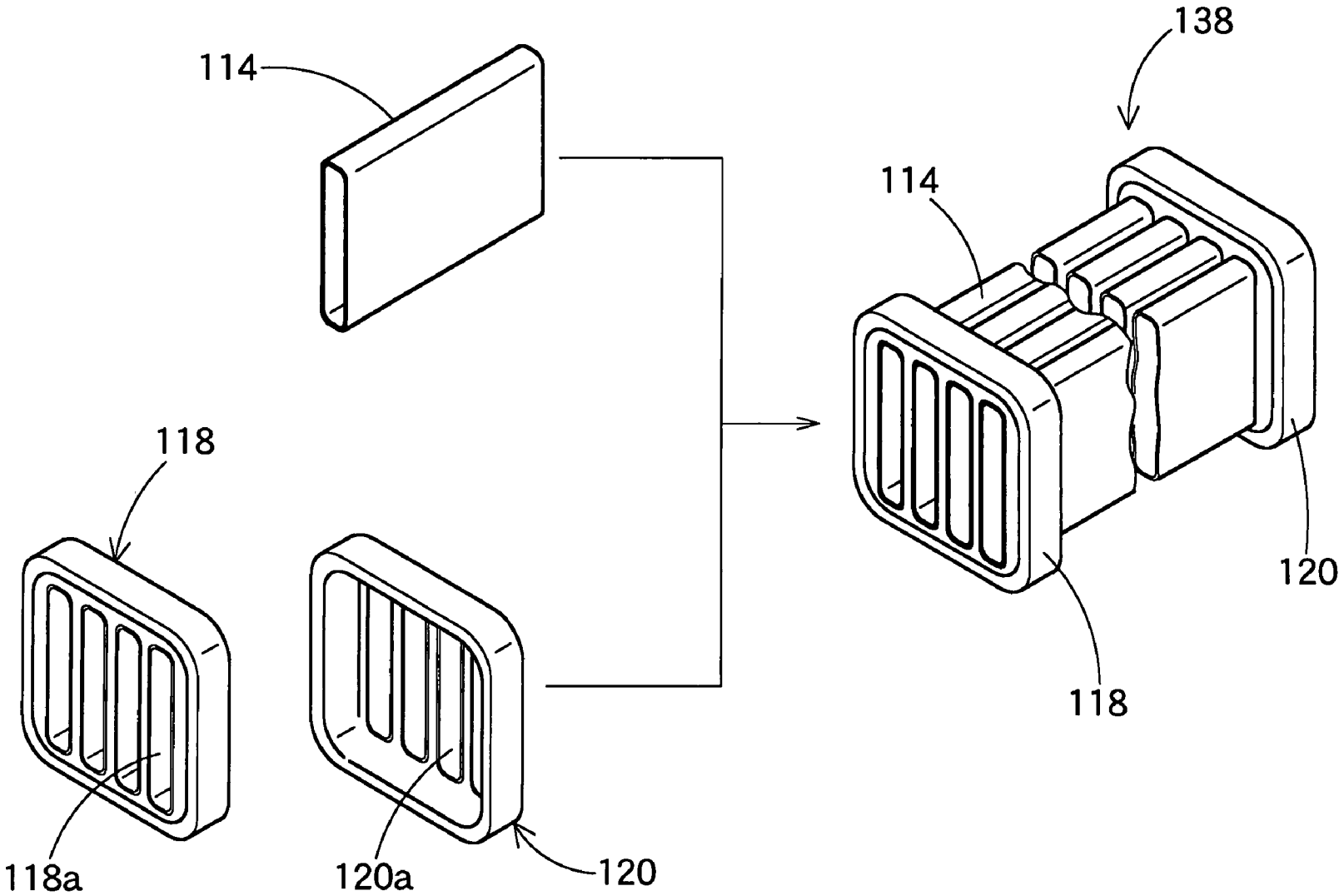
FIG. 14 is a manufacturing process diagram of a heat transmitting tube in the multi-tube heat exchanger according to the present invention.

First, as shown in FIG. 14, a flat tube (section of short cut section in this Figure) 134, which turns to a heat transmitting tube main body, and introduction side/discharge side holding plates (tube sheets) 118, 120 are prepared. Here, the section of the flat tube may be rectangular or elongated circle. Preliminarily, a number of lump-like projections (not shown) are formed at a predetermined distance (predetermined pitch) in the length direction on one or both of opposing wall faces on longer sides of the flat tube 134 by press treatment such as stamping.

Meanwhile, although the thickness of each of the flat tube (heat transmitting tube main body) 134 and the introduction/discharge side holding plate differs depending upon used material and endurance period, for example, that of the former should be 0.1–1.0 mm (preferably 0.3–0.8 mm) and that of the latter should be 0.5–3 mm (preferably 1–2 mm) in case of stainless.

Next, according to the above-described embodiment, by inserting the respective heat transmitting tubes 114 into heat transmitting tube holding holes 118*a*, 120*a* formed in the insertion side/discharge side holding plates 118, 120 and coupling them, the heat transmitting tube unit 138 is prepared. The coupling style at this time shall be usually soldering (soldering). As for the solder material for use at this time, for example, if the material of the heat exchanger is of stainless, usually, copper solder or nickel solder shall be used. Heating/cooling condition upon soldering is set up considering the kind and heat capacity of the solder material.

After the outer periphery of the introduction side/discharge side holding plates 118, 120 of the heat transmitting tube unit 138 is coated with soldering material, it is inserted partly into the square rod body 116 and then the large-diameter side of the pyramid frustum cylinder which constitutes the rectifying portion 118. On the other hand, the introduction port/discharge port (connecting pipe) 126, 128 integrated with the flanges 126*a*, 128*a* are inserted into the smaller diameter side and coupled (finally fixed) with each other.

Although as this coupling (final fixing) means, TIG welding or laser welding, which produces little oxidation deterioration and secures coupling strength easily, is preferable, other arc welding, resistance welding or coupling with heat resistant adhesive agent is acceptable.

In the meantime, the body (outer tube) 116 may be divided to halves and coupled together later. In this case, after other components than the body 116 are integrated by the aforementioned resistance welding/soldering or the like, the body 116 is integrated by resistance welding in a separate process. Thus, preferably, although the number of manufacturing steps is increased, a problem about metallic crack due to differences in soldering heat efficiency and cooling velocity between the front surface and inner surface after the soldering unlikely occurs.

Although the above description has picked up an example of the heat exchanger which executes heat exchange by passing high-speed, high-temperature gas (gas) through the straight heat transmitting tube (inner tube) while cooling water (liquid) through the body (outer tube), a combination of the first fluid and the second fluid may be determined arbitrarily as long as there is a difference in temperature which allows heat exchange. Usually, emission gas of automobile to be passed through the heat exchanger has a gas velocity of 0–50 m/s and a gas temperature of 120–700° C.

However, usually, preferably, selection of the first fluid (which passes through the inner tube) and the second fluid (which passes through the outer tube) is carried out based on the standard described below (see pp. 365–366, "KAGAKU KOGAKU JITEN" edited by KAGAKU KOGAKU KYOKAI, published by MARUSEN, May 30, 1974).

Fluid to be passed through the inner tube (in the tube): corrosive fluid, fluid which pollutes the tube wall remarkably, high-pressure fluid, high-temperature fluid requesting a special material.

Fluid to be passed through the outer tube (out of the tube): fluid whose flow rate is small, fluid whose viscosity is high, fluid whose tolerable pressure loss is small The present invention can also be applied to an example in which the heat transmitting tubes are bent halfway and an example in which the heat transmitting tubes are bent in U shape so that both ends thereof are located on the same side.

Naturally, the present invention can be applied to a heat exchanger in which the rectifying portion (rectifying chamber) is provided on only an end and the introduction-in/-out ports are located on the same side while that end portion is partitioned with a partition plate.

The invention claimed is:

1. A multi-tube heat exchanger comprising an inner tube group in which a first fluid passes and an outer tube in which a second fluid passes, both ends of each inner tube in said inner tube group being held and disposed on introduction/discharge side holding plates located on each of first fluid introduction side and first fluid discharge side, wherein each said inner tube is constituted of only an inner tube main body having a substantially flat section and a number of parallel sheet-like or lump-like projections disposed at locations extending across substantially a full width of the interior of the heat transmitting tube main body at a predetermined interval in the length direction and width direction on one or both of opposing wall faces on longer sides of the inner tube main body, wherein said projections are formed obliquely on said one wall face and in parallel on said opposing wall face between the obliquely-arranged projections in the length direction in parallel to the gas flow.

* * * * *